US008266777B2

(12) United States Patent
Kincaid

(10) Patent No.: US 8,266,777 B2
(45) Date of Patent: Sep. 18, 2012

(54) METHOD OF INSTALLING A BATHTUB LINER USING A LIQUID ADHESIVE

(76) Inventor: Callie Jeffrey Kincaid, Lagrange, IL (US)

( * ) Notice: Subject to any disclaimer, the term of this patent is extended or adjusted under 35 U.S.C. 154(b) by 400 days.

(21) Appl. No.: 12/719,787

(22) Filed: Mar. 8, 2010

(65) Prior Publication Data

US 2010/0223777 A1 Sep. 9, 2010

Related U.S. Application Data

(60) Provisional application No. 61/158,376, filed on Mar. 8, 2009.

(51) Int. Cl.
*A47K 3/00* (2006.01)

(52) U.S. Cl. ..... 29/428; 29/890.141; 29/890.144; 29/458

(58) Field of Classification Search ..... 29/458, 29/428, 890.141, 890.144
See application file for complete search history.

(56) References Cited

U.S. PATENT DOCUMENTS

| | | | | |
|---|---|---|---|---|
| 3,614,793 | A * | 10/1971 | Nemiroff | 4/580 |
| 4,043,853 | A * | 8/1977 | Saladino | 156/94 |
| 5,560,092 | A * | 10/1996 | Roiger | 29/402.08 |
| 5,902,444 | A * | 5/1999 | Falkner et al. | 156/329 |
| 6,319,546 | B1 * | 11/2001 | Coven | 427/140 |
| 2008/0040849 | A1 * | 2/2008 | Brandenstein | 4/580 |
| 2011/0035872 | A1 * | 2/2011 | Hasselbring | 4/580 |

FOREIGN PATENT DOCUMENTS

DE 102007051924 A1 * 4/2009

* cited by examiner

*Primary Examiner* — Derris Banks
*Assistant Examiner* — Kaying Kue
(74) *Attorney, Agent, or Firm* — Michael Ries

(57) ABSTRACT

The present invention is an improved method of installing a bathtub liner in a bathtub, with a liquid adhesive. The method steps include removing the bathtub drain and overflow protection device, templating and cutting the bathtub liner to properly fit into the bathtub, cleaning the bathtub, forming a foam rail gasket, setting the bathtub liner into place and forming the bathtub liner drain, removing the set bathtub liner and cleaning the bathtub liner, applying tub and wall adhesive and sealant between the bathtub and the bathtub liner, resetting the liner into place and installing the bathtub drain and stopper, installing any accessories, pouring the liquid adhesive between the liner and the bathtub, flushing away any unnecessary liquid adhesive and catalyzing the liquid adhesive.

14 Claims, 5 Drawing Sheets

METHOD OF INSTALLING A BATHTUB LINER USING A LIQUID ADHESIVE

This application claims priority to U.S. Provisional Application 61/158,376 filed on Mar. 8, 2009, the entire disclosure of which is incorporated by reference.

TECHNICAL FIELD & BACKGROUND

The present invention generally relates to an improved method of installing a bathtub liner. More specifically, the invention is an improved method of installing a bathtub liner using a liquid adhesive, instead of layers of butyl tape or expanding foam adhesive.

Bathtub liners have traditionally and most commonly been installed using layers of butyl tape or expanding foam adhesive. Both methods have problems inherent with their application and both methods require the installer to estimate how much adhesive will be needed to perform the installation. Using butyl tape, the installer estimates how many layers of tape will be needed and applies them to the bottom of the liner. This methodology leaves gaps and spaces between the rows of butyl tape and contributes to the feel of a soft bottom on the bottom of the liner. In addition it fills only the space on the very bottom of the liner and contributes no support around the edges. The expanding foam method also requires the installer to estimate the space between the liner and the tub. The foam adhesive is applied to the bottom of the tub and the liner is quickly inserted into the tub. Pressure is then applied to the surface of the liner using a roller to spread the foam uniformly. Unless performed perfectly, this process leaves air pockets trapped below the liner. The pressure exerted by the expanding foam also causes a certain amount of stress around the bottom of the liner that can behave in an unpredictable manner. This pressure can cause the liner to delaminate at a later date or cause humps to form.

It is also an object of the invention to provide a method of installing a bathtub liner that does not require an installer to estimate how much adhesive is required to install the bathtub liner.

It is also an object of the invention to provide a method of installing a bathtub liner that fills all available space below the installed liner and creates a solid feel when the bathtub is cured.

It is also an object of the invention to provide a method of installing a bathtub liner that reinforces around the edges of the installed liner and creates a waterproof installation.

It is also an object of the invention to provide a method of installing a bathtub liner where adhesives are not applied before installing the liner, thereby eliminating an installer to estimate required adhesive quantities, which may create gaps in the adhesive.

What is really needed is a method of installing a bathtub liner that uses liquid adhesive instead of layers of butyl tape or expanding foam adhesive, that fills all available space below the installed liner, creates a solid feel when the bathtub is cured, that reinforces around the edges of the installed liner and creates a waterproof installation.

BRIEF DESCRIPTION OF THE DRAWINGS

The present invention will be described by way of exemplary embodiments, but not limitations, illustrated in the accompanying drawings in which like references denote similar elements, and in which.

DETAILED DESCRIPTION OF ILLUSTRATIVE EMBODIMENTS

Various aspects of the illustrative embodiments will be described using terms commonly employed by those skilled in the art to convey the substance of their work to others skilled in the art. However, it will be apparent to those skilled in the art that the present invention may be practiced with only some of the described aspects. For purposes of explanation, specific numbers, materials and configurations are set forth in order to provide a thorough understanding of the illustrative embodiments. However, it will be apparent to one skilled in the art that the present invention may be practiced without the specific details. In other instances, well-known features are omitted or simplified in order not to obscure the illustrative embodiments.

Various operations will be described as multiple discrete operations, in turn, in a manner that is most helpful in understanding the present invention. However, the order of description should not be construed as to imply that these operations are necessarily order dependent. In particular, these operations need not be performed in the order of presentation.

The phrase "in one embodiment" is used repeatedly. The phrase generally does not refer to the same embodiment, however, it may. The terms "comprising", "having" and "including" are synonymous, unless the context dictates otherwise.

Figure 1A:
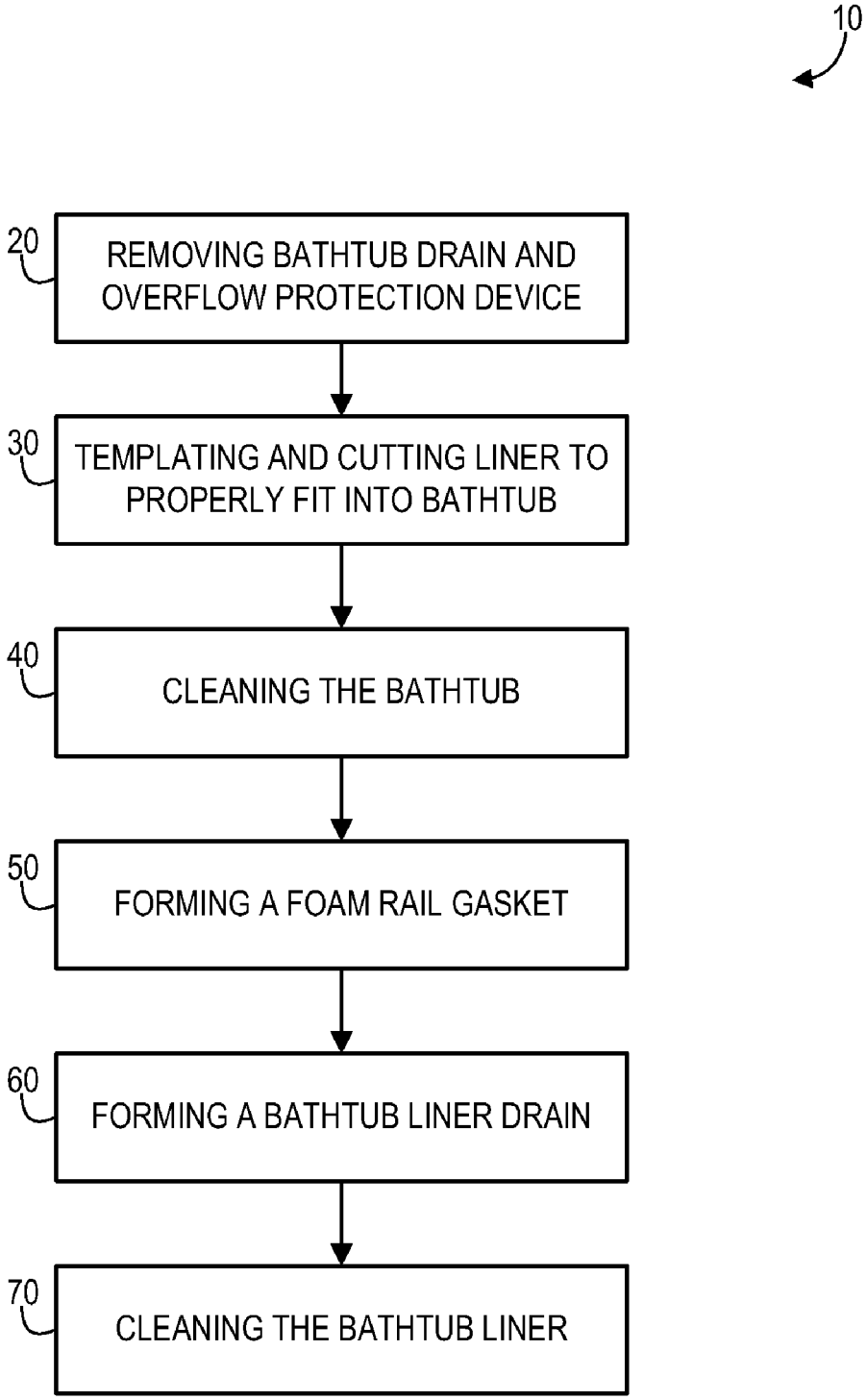
FIGS. 1A and 1B illustrate a flowchart outlining the steps of an improved overall method of installing a bathtub liner using a liquid adhesive, in accordance with one embodiment of the present invention.
Figure 1B:
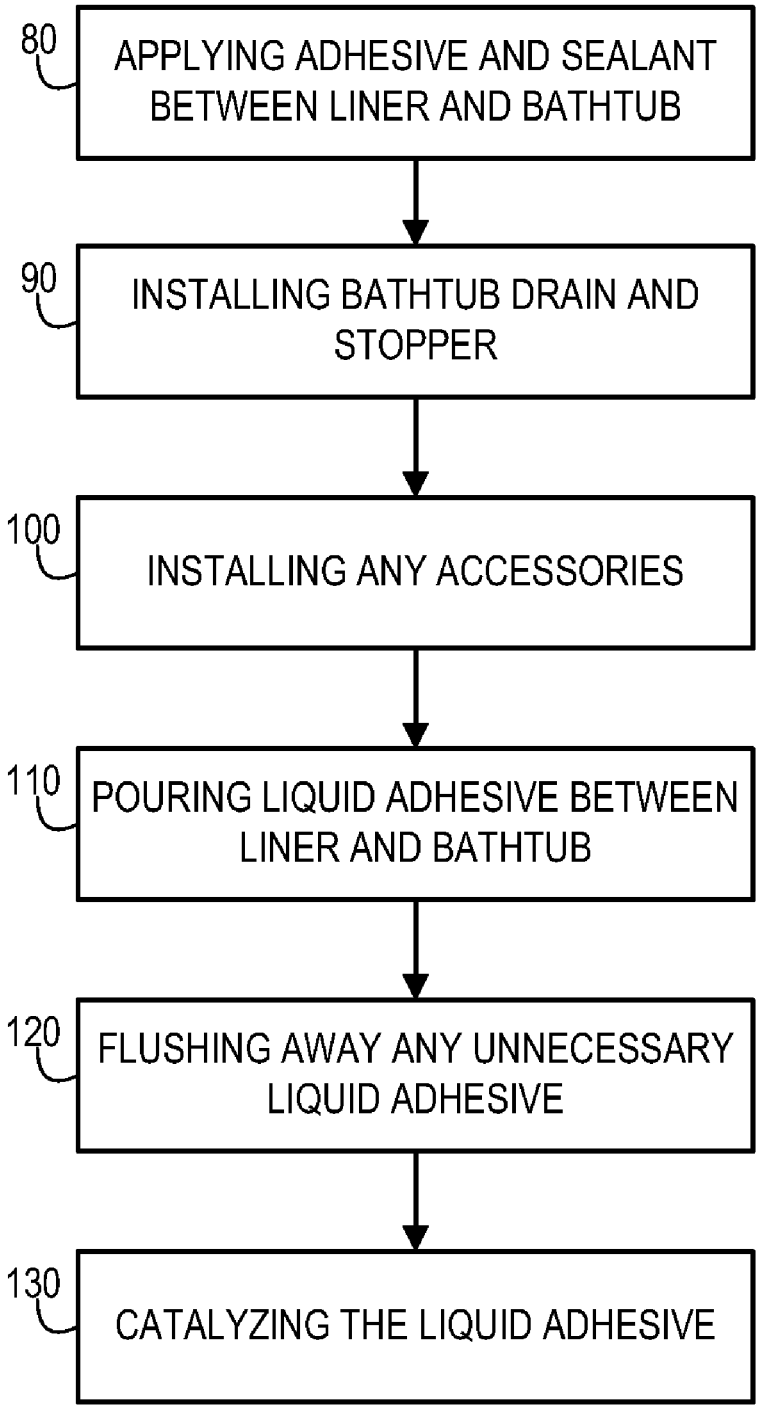

FIGS. 1A and 1B illustrate a flowchart outlining the steps of an improved overall method of installing a bathtub liner using a liquid adhesive 10. The overall method steps 10 include removing the bathtub drain and overflow protection device 20, cleaning the bathtub 30, templating and cutting the bathtub liner to properly fit into the bathtub 40, forming a foam rail gasket 50, setting the bathtub liner into place inside the bathtub while forming the bathtub liner drain 60, removing the set bathtub liner and cleaning the bathtub liner 70, applying tub and wall adhesive and sealant between the bathtub and the bathtub liner 80, resetting the liner into place and installing the bathtub drain and stopper 90, installing any accessories 100, pouring the liquid adhesive between the liner and the bathtub 110, flushing away any unnecessary liquid adhesive 120 and catalyzing the liquid adhesive 130. These steps will be described in greater detail in the FIGS. 2A, 2B and 3 descriptions.

Figure 2A:
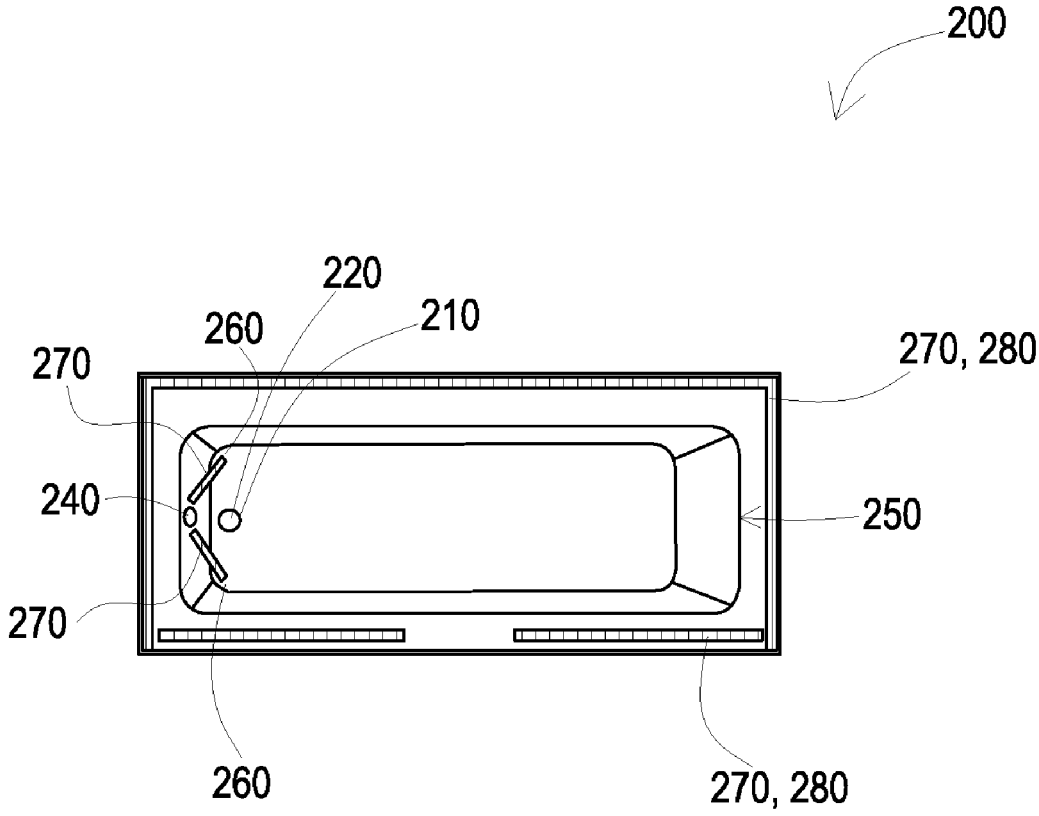
FIG. 2A illustrates an overhead perspective view of a bathtub liner to be installed in a bathtub, in accordance with one embodiment of the present invention.
Figure 2B:
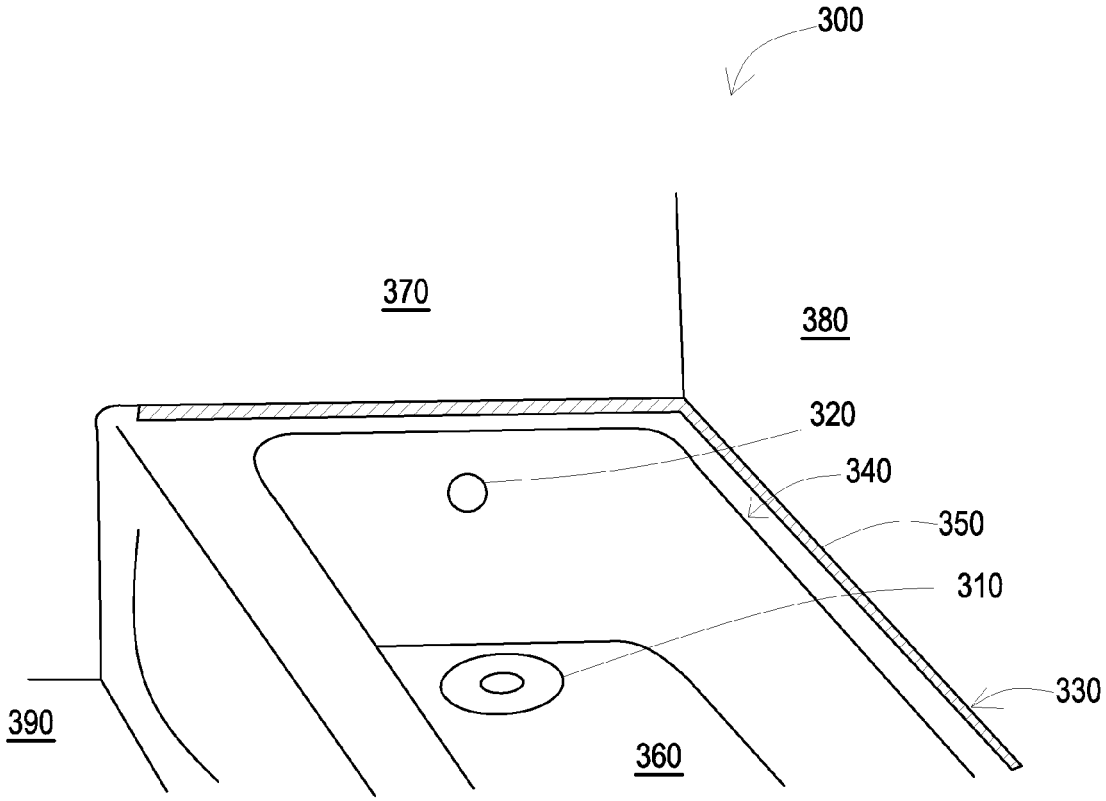
FIG. 2B illustrates a diagonal overhead side perspective view of a bathtub before a bathtub liner installation, in accordance with one embodiment of the present invention.

The improved method of installing a bathtub liner with liquid adhesive 10 utilizes a bathtub liner 200 with a drain aperture 210, a drain 220, a drain stopper (not shown), an overflow aperture 240, a back side 250 and two front interior corners 260. The improved method of installing a bathtub liner with liquid adhesive 10 also utilizes a bathtub 300 with a drain 310, an overflow protection device 320, an overall shape 330, a shelf area 340, a rim 350 and a belly 360, that is adjacent to a plumbing wall 370 and a soap dish wall 380 that also sits on a floor 390. These described details of the bathtub liner 200 are illustrated in FIG. 2A and the described details of the bathtub 300 are illustrated in FIG. 2B.

The first step of the improved method of installing a bathtub liner with liquid adhesive is removing the bathtub drain and said overflow protection device of the bathtub 20. Typically with the bathtub drain 310, this is done with a socket and wrench tool (not shown), but any tool that can remove a bathtub drain 310 can also be used. Also the overall method 10 is not limited to any particular bathtub 300 or bathtub drain 310, since any bathtub 300 or bathtub drain 310 that is known to those skilled in the art can be utilized with the overall method 10, as long as it does not negatively affect the adhesion between the bathtub 300 and the bathtub liner 200. This is true for an overflow protection device 320 also, although one overflow protection device 320 that is commonly used is an overflow plate and crossbar (not shown). The overall method 10 is not limited to any particular overflow protection device 320, since any overflow protection device 320 that is known to those skilled in the art can be utilized with the overall method 10, as long as it does not negatively affect the adhesion between the bathtub 300 and the bathtub liner 200.

The second step of the overall method is cleaning the bathtub with existing soap scum, debris and old caulk to ensure a proper fit, prior to the installation 30. It is important that the bathtub 300 be clean in order for the best adherence to be achieved between the bathtub 300 and the bathtub liner 200. Any chemical method, physical method or combination of chemical and physical method of soap scum cleaning that is known to those skilled in the art can be incorporated into the overall method 10, as long as it does not negatively affect the adhesion between the bathtub 300 and the bathtub liner 200. Debris can also be cleaned using any chemical method, physical method or combination of chemical and physical method of debris cleaning that is known to those skilled in the art can be incorporated into the overall method 10, as long as it does not negatively affect the adhesion between the bathtub 300 and the bathtub liner 200. Old caulking on the bathtub 300 should also be cleaned and removed, which is commonly done with a manual razor and/or scraper, although any chemical method, physical method or combination of chemical and physical method of old caulking cleaning and removal that is known to those skilled in the art can be incorporated into the overall method 10, as long as it does not negatively affect the adhesion between the bathtub 300 and the bathtub liner 200.

The method of cleaning the bathtub 30 can also involve grinding or sanding off any existing paint on the belly of the bathtub 360. Any method of grinding or sanding off any existing paint on the belly of the bathtub 360 that is known to those schooled in the art can be used, as long as it doesn't negatively affect the adhesion between the bathtub 300 and the bathtub liner 200. It is important in removing any dust and debris formed on the bathtub 300 after grinding off or sanding any paint with a tack cloth and/or a clean rag and a denatured alcohol (DNA) and water solution. The best mode of removing any dust and debris formed on the bathtub 300 after grinding or sanding is when a 50% solution of DNA and 50% water is used for cleaning. The entire bathtub 300, drain 310, overflow protection device 320, overall shape 330, shelf area 340, rim 350, belly 360 and contact areas of the plumbing wall 370, the soap dish wall 380 and floor 390 should be cleaned using the described best mode to achieve the best cleaning result.

The third step of the overall method is templating and cutting the bathtub liner to properly fit into the overall shape of the bathtub 40. Templating is defined as using a template (not shown) to make and manufacture the bathtub liner 20 by inserting a template into the bathtub 300 that the liner 200 will be inserted into. The template should be placed on the tub's shelf area 340 and adjusted so there are as few gaps as possible between the template and plumbing wall 370, the soap dish wall 380 and any other adjacent wall. The template should also be firmly in place with no movement while against any adjacent walls. The most important part of templating is being able to place the template on the liner 200 to match the adjacent bathtub walls. However, any accurate templating method that is known to those schooled in the art can be used, as long as it doesn't negatively affect the adhesion between the bathtub 300 and the bathtub liner 200. Any method of cutting the liner 200 that is known to those schooled in the art can be used, as long as it doesn't negatively affect the adhesion between the bathtub 300 and the bathtub liner 200. It is also very important that the liner 200 be cut and trimmed so that it is not binding against any adjacent walls.

The fourth step of the overall method is applying acrylic rail tape 270 to the bathtub shelf area 340 away from the plumbing wall 370, the soap dish wall 380 and any other adjacent wall, forming a foam rail gasket 280 around the rim of the bathtub 350. The rail tape 270 should be applied around the shelf area of the bathtub 340 ¼" to ⅜" away from any adjacent wall and should be applied in a continuous fashion with no breaks. Two lines of rail tape 270 should also stretch diagonally from the overflow aperture 240 to the front interior corners of the bathtub liner 260, to create space for the liquid adhesive 400 to flow while being poured.

The fifth step of the overall method is setting the bathtub liner into place in the bathtub and forming the bathtub liner drain 60. It is of utmost importance that the bathtub liner drain 220 be formed during installation of the bathtub liner 200. Any method of forming the bathtub liner drain 60 that is known to those schooled in the art can be used, as long as it doesn't negatively affect the adhesion between the bathtub 300 and the bathtub liner 200. The method of setting and forming the bathtub liner drain 60 should also allow for expansion and contraction of the bathtub liner 200 and the drain aperture 210.

Once the fifth step of the overall method 60 is completed, the sixth step of the overall method should be performed, which is removing the set bathtub liner and cleaning the bathtub liner 70. Emphasis should be on cleaning the back side of the liner 250, which should be done with a tack cloth and/or a rag and a denatured alcohol (DNA) and water solution. The best mode of cleaning the bathtub liner 200 is when a 50% solution of DNA and 50% water is used for cleaning, which produces the best cleaning results.

The seventh step of the overall method is applying tub and wall adhesive and sealant on the bathtub shelf area between the foam rail gasket and the adjacent walls 80. The adhesive and sealant 410 should be applied with an approximate ⅜" thick bead between the rail tape 270 and any adjacent walls, with no air gaps being formed in any corners where the adhesive and sealant 410 is applied. 2 to 3 beads of adhesive and sealant 410 should also be provided around the drain 220 and drain aperture of the liner 210 to seal the drain 220. Any remaining adhesive and sealant 410 can be used along the sides of the bathtub 300 to take any play out of the liner 200 once the liner 200 has been installed.

The eighth step of the overall method is resetting the liner into place and installing the bathtub drain and the stopper 90. The flange of the bathtub drain 220 is then provided with a bead of adhesive and sealant 410 or approved plumber's putty to seal and protect the drain 220 from water and moisture. Once the drain 220 is installed, the drain 220 should be tightened until it is snug and then backed off a quarter turn to relieve stress at the drain 220. This additionally involves cleaning any tub and wall adhesive 410 that is squeezed out at the adjacent walls and around the bathtub drain 220. Pressure should then be applied on top of the tub liner under the bathtub shelf area 340 to ensure better foam rail gasket 280 and adhesive and sealant 410 contact and adhesion. The adhesive and sealant 410 in this step 90 and any step of the overall method 10 is always silicone based.

The tenth step of the overall method is installing any walls and accessories and caulking all joints except around the bathtub liner 100. Accessories can be any bathtub accessories and conveniences that are known to those schooled in the art, as long as they don't negatively affect the adhesion between the bathtub 300 and the bathtub liner 200.

Figure 3:
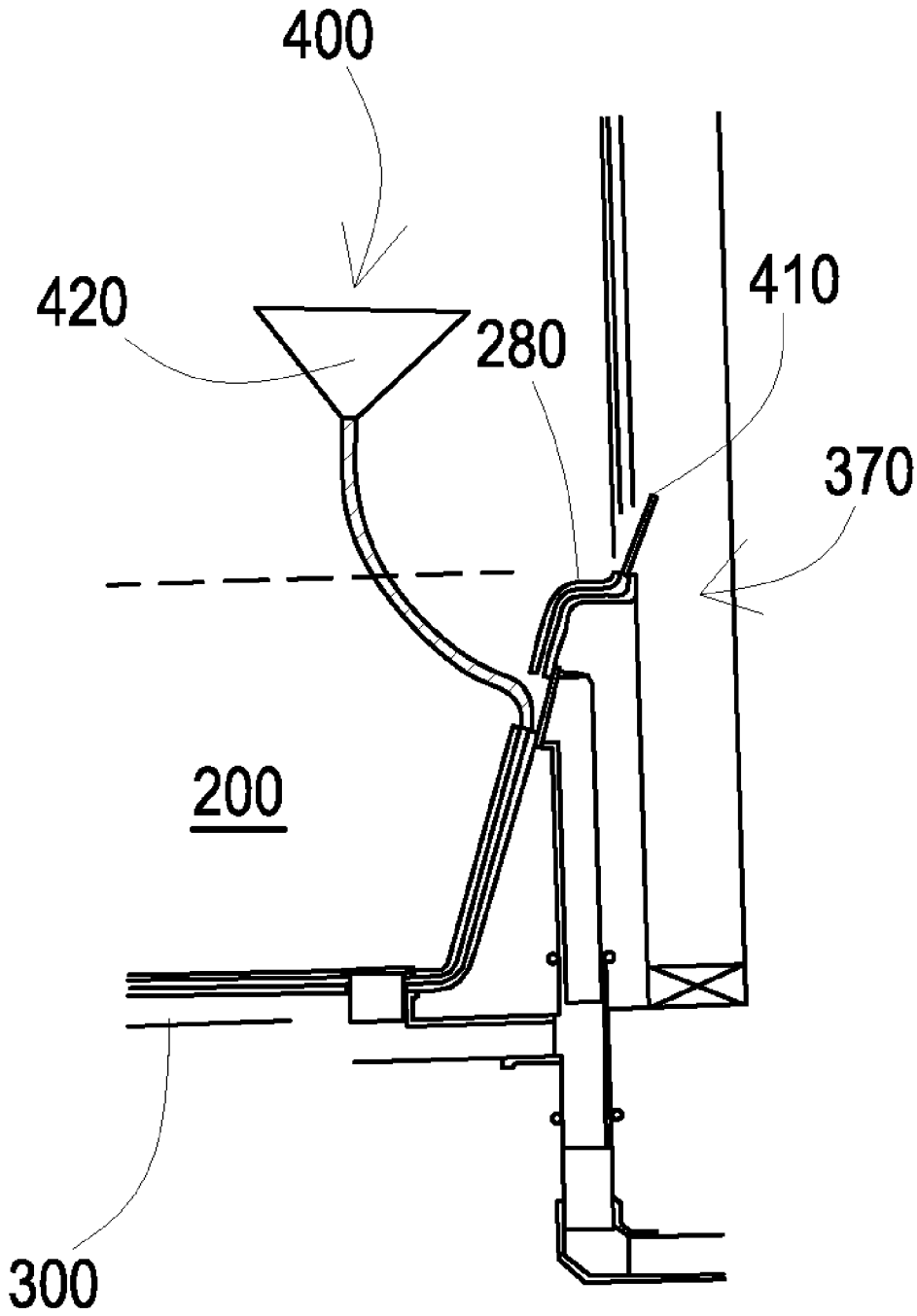
FIG. 3 illustrates a side perspective view of liquid adhesive being poured between a bathtub and an applied bathtub liner, in accordance with one embodiment of the present invention.

The eleventh step of the overall method is inserting a gooseneck funnel 420 between the liner and the bathtub through the liner overflow aperture and pouring the liquid adhesive slowly into the funnel 420 which directs the liquid adhesive between the liner and the bathtub 110. This step 110 is also depicted in FIG. 3, which illustrates a side perspective view of the liquid adhesive 400 being poured between a bathtub 300 and an applied bathtub liner 200. This step 110 additionally includes pouring to prevent the liquid adhesive 400 from backflowing into the overflow aperture 240 and allowing any backflowed liquid adhesive 400 to drain through the overflow aperture 240 before continuing to pour the liquid adhesive 400. Any liquid adhesives 400 designed for installing a bathtub liner 200 that are known to those schooled in the art can be used, as long as they don't negatively affect the adhesion between the bathtub 300 and the bathtub liner 200.

The twelfth step of the overall method is opening the stopper (not shown) and pouring hot water into the tub liner and flushing any liquid adhesive that has gone down the overflow aperture out of the liner and bathtub vicinity 120.

The thirteenth step of the overall method is closing the stopper and allowing additional hot water to accumulate and stand in the bathtub liner once any liquid adhesive has been flushed away, to catalyze the poured liquid adhesive 130. A range of 3 to 4 inches of hot water in height accumulates and stands in the bathtub liner 200 to catalyze the liquid adhesive 400 from the heat from the standing hot water. The liquid adhesive 400 will be solidified 30 to 45 minutes after being poured and will become firmer and reach a hard rubber-like consistency after 24 to 48 hours. Once the liquid adhesive 400 reaches this hard rubber-like consistency, the newly lined bathtub 300 is ready to be used.

While the present invention has been related in terms of the foregoing embodiments, those skilled in the art will recognize that the invention is not limited to the embodiments described. The present invention can be practiced with modification and alteration within the spirit and scope of the appended claims. Thus, the description is to be regarded as illustrative instead of restrictive on the present invention.

What is claimed is:

1. A method of installing a bathtub liner with a drain aperture, a drain, a drain stopper, an overflow aperture, a back side and two front interior corners, in a bathtub with a drain, an overflow protection device, an overall shape, a shelf area, a rim and a belly, that is adjacent to a plumbing wall, a soap dish wall and other adjacent walls that also sit on a floor, using liquid adhesive, which comprises:

removing said bathtub drain and said overflow protection device;

cleaning said bathtub of existing soap scum, debris and old caulk to ensure said proper fit between said bathtub and said liner, prior to said installation;

templating and cutting said bathtub liner to properly fit into said overall shape of bathtub;

applying acrylic rail tape to said bathtub shelf area away from said plumbing wall and said soap dish wall, forming a foam rail gasket around said rim of bathtub;

setting said bathtub liner into place in said bathtub and forming said bathtub liner drain;

removing said set bathtub liner and cleaning said back side of bathtub liner with a tack cloth, a rag and a denatured alcohol (DNA) and water solution;

applying tub and wall adhesive and sealant on said bathtub shelf area between said foam rail gasket and said walls;

resetting said liner into place and installing said bathtub drain and said stopper;

installing any said walls and accessories and caulking all joints except around said bathtub liner;

inserting a gooseneck funnel between said liner and said bathtub through said liner overflow aperture and pouring said liquid adhesive slowly into said funnel which directs said liquid adhesive between said liner and said bathtub;

opening said stopper and pouring hot water into said tub liner and flushing any said liquid adhesive that has gone down said overflow aperture out of said liner and said bathtub vicinity; and closing said stopper and allowing additional said hot water to accumulate and stand in said bathtub liner once all said liquid adhesive has been flushed away.

2. The method of removing said bathtub drain and said overflow protection device, as recited in claim 1, wherein said overflow protection device is an overflow tube and plate.

3. The method of cleaning said bathtub of existing soap scum, debris and old caulk, as recited in claim 1, further comprising:

grinding and sanding off any existing paint on said belly of bathtub; and removing any dust and debris formed on said bathtub after said grinding and sanding with a tack cloth, a clean rag and a denatured alcohol (DNA) and water solution.

4. The method of removing said dust and debris formed on said bathtub after said grinding and sanding, as recited in claim 3, wherein said DNA and water solution is 50% DNA and 50% water.

5. The method of applying acrylic rail tape to said bathtub shelf area, as recited in claim 1, wherein two lines of rail tape stretch diagonally from said overflow aperture to said front interior corners of said bathtub to create space for said liquid adhesive to flow.

6. The method of setting said bathtub liner into place and forming said bathtub liner drain, as recited in claim 1, wherein said bathtub liner must be in place in order to properly fit said bathtub liner drain during said bathtub liner installation.

7. The method of resetting said bathtub liner, as recited in claim 1, further comprising:

filling an area around said drain with said tub and wall adhesive and sealant to seal and protect said drain from water and moisture;

applying pressure on top of said tub liner area under said bathtub shelf area to ensure better said foam rail gasket and said adhesive and sealant contact and adhesion; and cleaning any said tub and wall adhesive that is squeezed out at said walls and around said bathtub drain.

8. The method of filling an area around said drain with said tub and wall adhesive and sealant, as recited in claim 7, wherein said adhesive and sealant is silicone based.

9. The method of applying tub and wall adhesive and sealant on said bathtub shelf area, as recited in claim 1, wherein said adhesive and sealant is silicone based.

10. The method of pouring said liquid adhesive, as recited in claim 1, further comprising:

pouring to prevent said liquid adhesive from backflowing into said overflow aperture; and allowing any said backflow liquid adhesive to drain through said overflow aperture before continuing pouring said liquid adhesive.

11. The method of closing said stopper and allowing additional said hot water to accumulate and stand in said bathtub liner, as recited in claim 1, wherein a range of 3 to 4 inches of said hot water in height accumulates and stands in said bathtub liner to catalyze said liquid adhesive.

12. The method of caulking remainder of said liner at said walls and said floor and installing said overflow protection device with said perimeter, as recited in claim 1, wherein said perimeter of said overflow protection device is sealed with caulk to prevent water and moisture from damaging said overflow protection device.

13. The method of draining said accumulated and standing water overnight for said liner and said bathtub to be used, as recited in claim 1, wherein said liquid adhesive will be solidified 30 to 45 minutes after being poured.

14. The method of draining said accumulated and standing water overnight for said liner and said bathtub to be used, as recited in claim 1, wherein said liquid adhesive will become firmer and reach a hard rubber-like consistency after 24 to 48 hours.

* * * * *